US008844771B2

(12) United States Patent
Centofante

(10) Patent No.: US 8,844,771 B2
(45) Date of Patent: Sep. 30, 2014

(54) HEMI-TOROIDAL FLUID PUMP

(75) Inventor: Charles A Centofante, Los Altos, CA (US)

(73) Assignee: Piranha Plastics, LLC, Los Altos, CA (US)

( * ) Notice: Subject to any disclaimer, the term of this patent is extended or adjusted under 35 U.S.C. 154(b) by 0 days.

(21) Appl. No.: 13/563,616

(22) Filed: Jul. 31, 2012

(65) Prior Publication Data

US 2014/0034681 A1 Feb. 6, 2014

(51) Int. Cl.
*B65D 37/00* (2006.01)

(52) U.S. Cl.
USPC ..... 222/214; 222/333; 222/207; 222/167; 222/168; 417/476; 417/477.3; 417/477.6; 417/477.9; 417/477.12

(58) Field of Classification Search
USPC ..... 222/214, 333, 207, 206, 167, 168, 169, 222/171; 417/476, 477.3, 477.6, 477.9, 417/477.12
See application file for complete search history.

(56) References Cited

U.S. PATENT DOCUMENTS 5,037,274 A * 8/1991 Holmes et al. ..... 417/53
6,142,340 A * 11/2000 Watanabe et al. ..... 222/66
6,948,638 B2 * 9/2005 Tu ..... 222/209
8,261,941 B2 * 9/2012 Woo et al. ..... 222/52
2003/0071072 A1 * 4/2003 Takahashi et al. ..... 222/214
2010/0108718 A1 * 5/2010 Sayers et al. ..... 222/207
2012/0111895 A1 * 5/2012 Fitzpatrick et al. ..... 222/214

OTHER PUBLICATIONS

International Search Report and Written Opinion in International Patent Application No. PCT/US13/53058, filed Jul. 31, 2013. 9 pages.

* cited by examiner

*Primary Examiner* — Paul R Durand
*Assistant Examiner* — Jeremy W Carroll
(74) *Attorney, Agent, or Firm* — Fish & Richardson P.C.

(57) ABSTRACT

This specification describes technologies relating to a pump for dispensing precise quantities of fluids. In some implementations, a pump includes a rotatable portion including one or more recesses configured to receive one or more corresponding roller components; and a base portion including a fluid channel including an input aperture and an output aperture, the fluid channel being configured to receive the one or more roller components, and a flexible membrane that provides a seal between the roller components and the fluid channel, wherein, the rotatable portion is rotatably coupled to the base portion such that the fluid channel includes one or more portions sealed by the flexible membrane and one or more roller components and wherein rotation of the rotatable portion causes the one or more roller components to traverse the fluid channel pushing fluid trapped within the fluid channel and the membrane in the direction of rotation.

10 Claims, 5 Drawing Sheets

HEMI-TOROIDAL FLUID PUMP

BACKGROUND

This specification relates to a pump for dispensing fluids.

Many conventional processes require a precise amount of fluids to be dispensed. Fluids e.g., liquids, can be conventionally dispensed in many ways including manual and mechanical pouring from a container to a receptacle. Many conventional techniques for dispensing fluids can have problems, for example, with accuracy and spilling.

SUMMARY

This specification describes technologies relating to a pump for dispensing precise quantities of fluids.

This specification describes a pump apparatus. The pump can dispense precise amounts of a specified fluid. A variety of fluids can be dispensed including colorants, pigments, oils, detergents, paints, reagents, chemicals, foods, beverages, fuel, inks, adhesives, medical fluids, solutions, solvents, blood, serum, or lactated Ringer's solution.

In some implementations, the pump can be operated manually using a hand crank, knob, or a recess on the pump lid. In some other implementations, the pump can be motorized either directly with a coupler attached to the pump lid, or indirectly using a gear, pulley, belt, or friction drive, attached to the pump lid. A motor can be coupled to a rotatable portion of the pump in order to drive the pump rotation. The motor can be controlled such that a specified rotation of the rotatable portion occurs, e.g., based on a number of degrees or amount of time at a specified rotational rate. As a result, a precise amount of fluid can be pumped from a fluid container and dispensed from an output port.

The pump includes an interior channel, e.g., formed in a ring or torus shape, or a hemispherical torus shape. A first side of the channel includes a flexible membrane. A second side of the channel includes one or more rollers, e.g., spherical rollers. The second side of the channel can complete a second side of the channel or can be substantially flat such that when the first and second side are joined a hemispherical ring is formed. The one or more rollers are configured to fill the channel such that, in combination with the flexible membrane, a fluid tight seal is formed in the channel. Consequently, as the pump is rotated (e.g., including the second side), the one or more rollers move along the channel such that fluid within the channel ahead of the one or more rollers is driven in the direction of rotation.

In general, one innovative aspect of the subject matter described in this specification can be embodied in a system including a pump including a rotatable portion including one or more recesses configured to receive one or more corresponding roller components; and a base portion including a fluid channel including an input aperture and an output aperture, the fluid channel being configured to receive the one or more roller components, and a flexible membrane that provides a seal between the roller components and the fluid channel, wherein, the rotatable portion is rotatably coupled to the base portion such that the fluid channel includes one or more portions sealed by the flexible membrane and one or more roller components and wherein rotation of the rotatable portion causes the one or more roller components to traverse the fluid channel pushing fluid trapped within the fluid channel and the membrane in the direction of rotation.

The foregoing and other embodiments can each optionally include one or more of the following features, alone or in combination. The system further includes a coupler configured to couple the base portion to a fluid container such that fluid from the fluid container can enter the fluid channel through the input aperture. The rotatable portion further includes a drive structure configured to cause the rotatable portion to rotate. The drive structure includes a plurality of gear teeth formed around an outer or inner circumference of the rotatable portion. The system further includes a motor coupled to the pump using the drive structure. The drive structure includes one or more of a gear, belt pulley, or friction drive. The system further includes a controller configured to drive the motor to dispense a specified amount of fluid. The base portion further includes a flexible membrane substantially lining the fluid channel, wherein the flexible membrane is deformed by the roller component forming a fluid seal.

In general, one innovative aspect of the subject matter described in this specification can be embodied in methods that include the actions of receiving a command to dispense a specified amount of a fluid; initiating a motor coupled to a fluid pump, the pump being coupled to a fluid container, wherein the motor causes a portion of the pump to rotate, and wherein rotation of the pump causes one or more roller components positioned within a fluid channel to traverse the fluid channel and wherein the traversal of the one or more roller components pushes fluid in the fluid channel in the direction of rotation toward an output aperture; and stopping the motor when the specified amount of fluid has been pumped from the container. Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In general, one innovative aspect of the subject matter described in this specification can be embodied in a pump including a rotatable portion including one or more recesses configured to receive one or more corresponding roller components; and a base portion including a fluid channel including an input aperture and an output aperture, the fluid channel being configured to receive the one or more roller components, and a flexible membrane that provides a seal between the roller components and the fluid channel, wherein, the rotatable portion is rotatably coupled to the base portion such that the fluid channel includes one or more portions sealed by the flexible membrane and one or more roller components and wherein rotation of the rotatable portion causes the one or more roller components to traverse the fluid channel pushing fluid trapped within the fluid channel and the membrane in the direction of rotation.

In general, one innovative aspect of the subject matter described in this specification can be embodied in a system including: a pump coupled to a motor and a fluid container, the pump including: a rotatable portion including one or more recesses configured to receive one or more corresponding roller components, the rotatable portion configured to be driven by the motor; and a base portion including a fluid channel including an input aperture for receiving fluid from the fluid container and an output aperture, the fluid channel being configured to receive the one or more roller components, and a flexible membrane that provides a seal between the roller components and the fluid channel, wherein, the rotatable portion is rotatably coupled to the base portion such that the fluid channel includes one or more portions sealed by the flexible membrane and one or more roller components and wherein rotation of the rotatable portion causes the one or more roller components to traverse the fluid channel pushing fluid trapped within the fluid channel and the membrane in the direction of rotation.

Particular embodiments of the subject matter described in this specification can be implemented so as to realize one or more of the following advantages. Precise amounts of fluids can be dispensed in a controlled manner. A dispensed amount can be controlled based on an amount of pump rotation e.g., based on time or degrees of rotation. The pump can be stand alone and connected to various containers for storage and discharge through tubing or it can be integrated with a fluid container to provide a single disposable pump and container combination. This can provide for a sealed environment as well as reducing leaks and contamination. The pump can be formed from plastic materials and assembled using, for example, sonic welding, laser welding, adhesive bonding, multiple shot molding, or snap fits. The pump is self-priming. The pump is also reversible such that the flow can be reversed with the same precision as the dispensing rotational direction. The pump does not contain any valves for trouble free operation.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
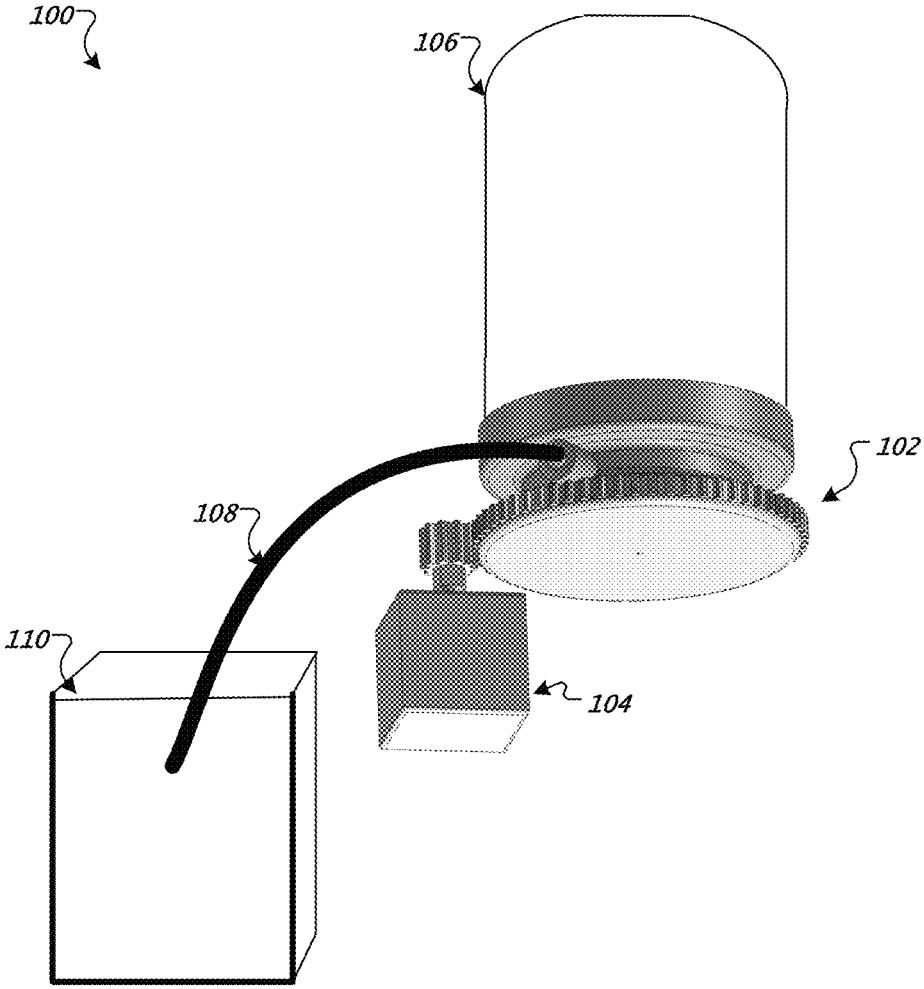
FIG. 1 shows an example pumping system.

FIG. 1 shows an example pumping system 100. The pumping system 100 includes pump 102, drive motor 104, fluid container 106, outlet path 108, and output container 110. The drive motor 104 is configured to drive a rotation of a rotatable portion of the pump 102. The drive motor 104 can be an electric motor, e.g., a stepper motor, linear motor, or electric actuator configured to drive a rotational driveshaft that engages the pump 102, for example, using a drive gear that is driven by the motor and that is coupled to a gear of the pump 102. Alternatively, the motor can be pneumatic, or hand driven, in both cases configured to transfer rotational or linear energy to a rotational driveshaft that can engage the pump 102.

The motor 104 can also include a programmable controller, either as a separate unit or as part of a motor 104, such that particular commands can be input in order to release a specified amount of fluid according to the command The controller can calculate motor driving time based on a specific flow rate of the pump for a given rate of rotation. The flow for the pump can be based on an amount of rotation of the pump. For example, the amount of fluid dispensed per degree of rotation can be calculated for various fluids. The amount of fluid dispensed per degree of rotation can vary for different fluids, in particular, for varying viscosity. The relationship between rotation and fluid dispensed can be determined empirically for different fluids.

To dispense a specified amount of a given fluid, a command can be issued to drive the motor so that the pump is rotated by a particular amount. The command can be issued based on the type of fluid and the amount to be dispensed. In some implementations, the motor is designed to dispense a single fluid. In such scenarios, the amount of rotation to dispense a specified amount of fluid is fixed. In some other implementations, the motor is designed to dispense different fluids. In such scenarios, a particular fluid can be specified so that the correct amount of rotation is determined for a given amount of that fluid to be dispensed.

In some other implementations, the amount of fluid dispensed can be determined according to a weight of the fluid dispensed. For example, one command can cause the motor to operate such that one gram of fluid is dispensed. A second command can cause the motor to dispense two grams of fluid. In each case, a scale is coupled to the motor such that when the pump is stopped when a specified weight of dispensed fluid is attained. Thus, a particular liquid can be dispensed in different amounts depending on the application. In some other implementations, motor commands are calibrated to dispense a particular fluid volume rather than weight, e.g., [x] number of milliliters.

The motor base 104 can include an interface for entering commands, e.g., for particular liquid dispensing. For example, one or more interface controls can allow the user to specify a particular command using menus, command codes, or a combination of both, e.g., using buttons, touch screen interface, or other input.

Alternatively, in some implementations, the motor 104 is coupled to another device that provides a control interface, for example, a computing device. The computing device can include software for both controlling the motor base 102 and providing a user interface. The user interface can allow the user to provide commands for dispensing liquids.

In some other alternative implementations, the motor 104 can be manually controlled, for example, when less precision is necessary. The motor 104 can simply include a activation control that the user can manually use to start and stop the motor 104. For example, the user can be provided with a flow rate for one or more fluids with respect to time of motor operation. The user can then calculate the time needed to operate the motor 104 in order to manually dispense the desired amount.

The motor 104 is coupled to the fluid container 106. The motor 104 can be coupled to the fluid container 106 using various techniques. In some implementations, the fluid container 106 is removable from the motor 104, e.g., using threads to screw or unscrew the fluid container 106 and motor 104. In some other implementations, the motor 104 and fluid container 106 form a single use integrated package joined, e.g., using sonic welding. The fluid container 106 and motor 104 can be oriented such that the fluid in the container is gravity fed to the pump 102. As a result, the pump 102 does not require priming before operation.

The fluid container 106 can include a vent or one way valve allowing fluid to be dispensed using the pump 104 without creating a vacuum. In some implementations, the fluid container 106 is configured with as a bag within a bag. In particular, a rigid or semi-rigid outer container can provide a specified form factor. An inner collapsible container can be positioned within the outer container. As fluid is dispensed, the inner container can collapse in on itself. In some implementations, plastic preforms can be molded to provide the inner and outer containers. Stretch blow molding can be used to expand the preform to form the fluid container 106. The fluid container 106 can be blow molded from an eva resin, e.g., Elvax®, to form a very flexible but durable container. In some other implementations, the fluid container 106 and the pump 104 are connected with a rigid or flexible tube, to allow separation of the fluid container and pump.

The fluid container 106 can provide a sealed fluid container that provides air tight dispensing. This can reduce the risk of contamination to the fluid. For example, some fluids react to oxygen, e.g., liquids that cure when exposed to air. Other fluids can easily be contaminated by particulates in the air resulting which can impair their function and also interfere with the dispensing. The fluid container 106 can be composed of various flexible materials, for example, low density polyethylene.

The output container 110 receives dispensed fluid. As shown in FIG. 1, output container 110 is coupled to output port of pump 102 by outlet path 108. Outlet path 108 can be a rigid or flexible tube coupling the output port of the pump 102 to the output container 110.

Alternatively, in some implementations, the output container 110 is directly connected to the pump 102. For example, the output port of the pump 102 can include a drip nozzle allowing the output fluid to drop into the output container 110. In another example, the output container 110 can directly connect to the pump such that the output fluid flows into the output container 110.

Figure 2:
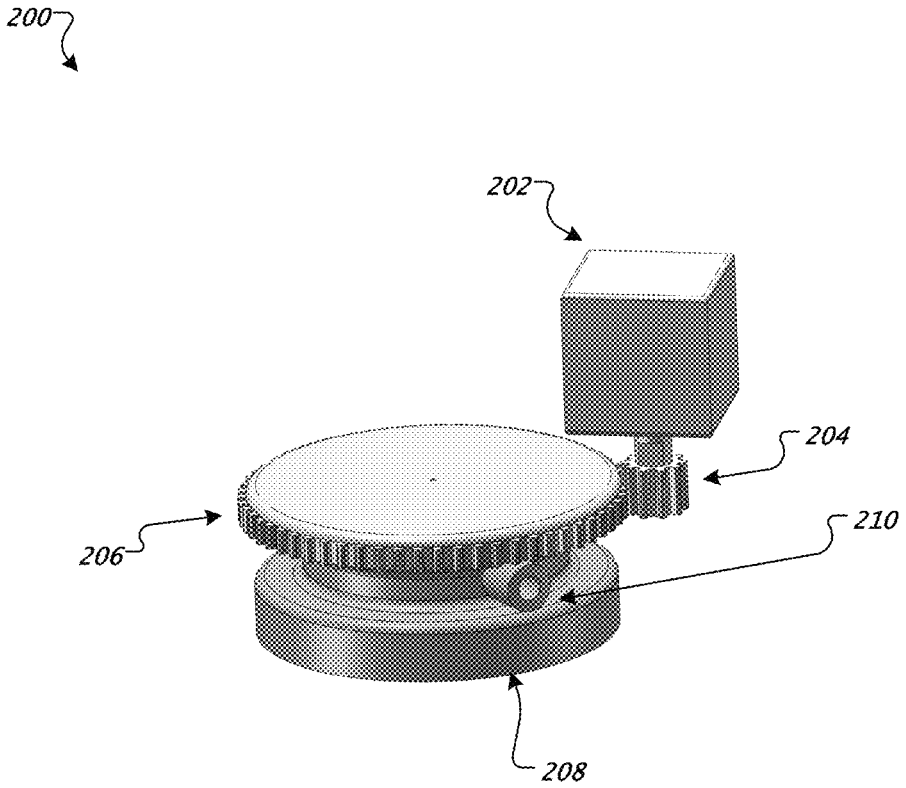
FIG. 2 shows an example fluid pump.

FIG. 2 an example fluid pump 200. The pump 200 includes a motor 202, drive gear 204, rotatable pump portion 206, and pump base 208. The motor 202 is configured to drive the drive gear 204, e.g., in response to a command from a controller, switch activation, etc. In some implementation, the drive gear 204 rotates about a central axis in response to a corresponding rotation of a drive component in the motor 202. As shown, the drive gear 204 includes a number of teeth that can engage a corresponding set of teeth in the rotatable pump portion 206. Thus, when the motor drives a rotational drive shaft coupled by the teeth to the drive gear 204, the rotatable pump portion 206 is rotated driving the pump 202 so that contents of a fluid container can be dispensed through an output port. The teeth can be shaped to facilitate transfer of energy from the motor to the pump. The gear on rotational pump portion 206 can be internal or external to the outside diameter of the rotational pump portion 206.

The drive gear 204 and rotatable pump portion 206 can be spur gears meshed together to provide a particular rate of rotation, e.g., based on gear ratio. Other types of gears can be used to couple the motor 202 to the rotatable pump portion 206 and the position of the motor 202 can be configured accordingly. For example, the gears can be helical gears, spiral bevel gears, worm gears, etc.

Alternatively, in some implementations, different drive structures can be used other than one or more gears to cause the rotatable pump portion to rotate. For example, friction can be used to drive the rotational pump portion, either with the shaft of drive motor 202 pressing against the outer portion of the rotational pump portion 206, or pressing on the center or near the center of the rotational pump portion 206. In some other implementations, a belt and pulley arrangement can be substituted for the outside drive gears.

The rotatable pump portion 206 is rotatably coupled to the pump base 208. The pump base 208 can be part of a fluid container, or can be configured to be coupled to a fluid container. The fluid container can be removably coupled to the pump base 208, for example, using a threaded portion. The threads can be either male or female. The pump base 208, can be coupled to a remote container by use of a rigid or flexible tube. The tube can be either removable, or integrated as part of the container and/or part of the pump base 208.

The pump base 208 also includes an outlet port 210. In operation, the motor 202 activates the drive gear 204. The drive gear 204 causes a rotation of the rotatable pump portion 206. The rotation pumps fluid from a fluid container to the output port 210. The inner mechanism for pumping fluid through rotation of the rotatable pump portion 206 is described below with respect to FIGS. 3 and 4.

Figure 3:
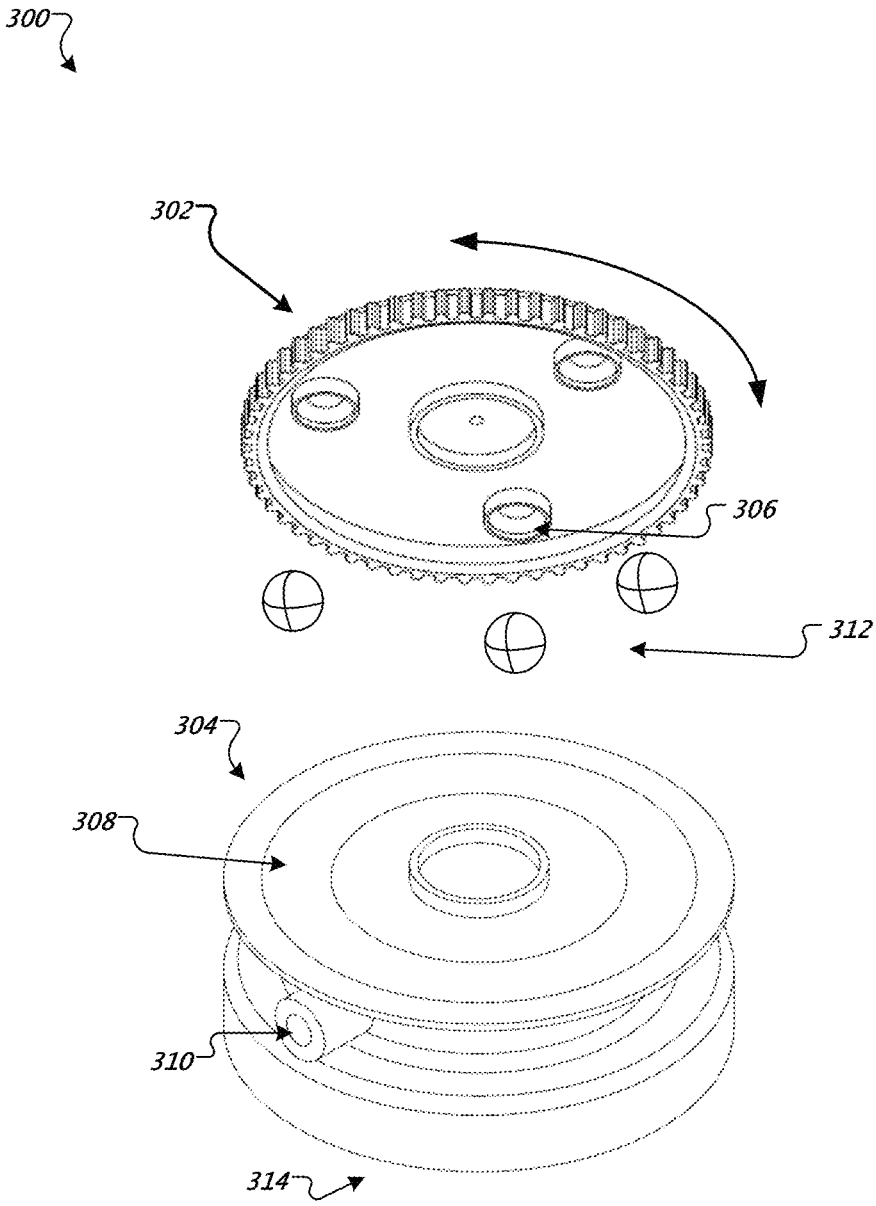
FIG. 3 shows an example partial exploded view of a fluid pump.

FIG. 3 shows an example partial exploded view of a fluid pump 300. The fluid pump 300 includes a rotatable portion 302 and a base portion 304.

The rotatable portion 302 can be substantially disk shaped. The rotatable portion 302 includes an outer edge portion that includes multiple teeth 303 around a circumference of the rotatable portion 302. The teeth 303 can engage with a gear, e.g., drive gear 204 of FIG. 2, in order to rotate the fluid pump 300 about an axis. The rotational portion 302 can be constructed, for example, with a molded-in gear, pulley, or other drive means, such as a gear fastened to the top of the rotational portion 302. The rotational portion 302 can be constructed, for example, using injection molding, casting, machining, or other means.

The rotatable portion 302 also includes a number of recesses 306 configured to receive corresponding roller components 312. The roller components can be spherical, cylindrical, or other suitable geometry. The recesses 306 maintain the position of the roller components 312 relative to the rotatable portion 302. Thus, as the rotatable portion 302 rotates relative to the base portion 304, the roller component 312 move with the corresponding recesses 306. In some implementations, the recesses 306 and roller components 312 are configured to allow the roller components 312 to rotate as the rotatable portion 302 is turned. While three roller component 312 are shown, any suitable number of roller components can be used and the rotatable portion 302 can be configured accordingly.

In some alternative implementations, the recesses 306 and roller components 312 can be replaced with molded elements having a fixed position on the rotatable portion. These molded elements, for example, hemispherical shaped protrusions, would rotate along with the rotatable portion.

The rotatable portion 302 can be composed of plastic material, for example, nylon. The rotatable portion 302 can be rotatable attached to the base portion 304, for example, using a pin, screw, bolt, rivet, snap fit, or other suitable element that provides a secure and tight connection and allows for the rotation of the rotatable portion 302 relative to the base portion 304. In some implementations, the rotatable portion 302 is removably attached to the base portion 304 such that the pump 300 can be at least partially disassembled. In some other implementations, the rotatable portion 302 is secured to the base portion 304 such that it cannot be removed without damaging the pump 300.

The base portion 304 includes a pump channel 308 including a flexible membrane, an outlet port 310, and coupler 314. The coupler 314 is configured to couple the base portion 304 of the pump 300 to a fluid container, e.g., fluid container 106. The outlet port 310 is configured to provide an output of a fluid pumped from the fluid container. In some alternative implementations, reversing the rotation of the rotatable portion 302 allows the pump 300 to operate in a reverse direction, pumping fluid entering the pump from the output port 310 into the fluid container.

The pump channel 308 provides a circular path in which the roller components 312 traverse as the rotatable portion 302 is rotated. The pump channel 308 can be shaped such that when the rotatable portion 302 is joined to the base portion 304, the pump channel 308 is sealed by compressing the flexible membrane, other than an input and output port (not shown). In some alternative implementations, molded elements attached to the rotatable portion are configured to fit within the pump channel, e.g., has hemispherical elements. The molded elements are positioned to fill the pump channel in a similar manner as the roller components, compressing the flexible membrane and pushing fluid as the rotatable portion is rotated.

Furthermore, at the one or more locations corresponding to the roller components 312, the pump channel 308 is blocked by the corresponding roller component 312. The pump channel can include a flexible membrane lining such that the roller components 312 distort the flexible membrane forming a substantially fluid tight seal in the pump channel 308. The flexible membrane can be formed from santoprene, polyurethane, silicone, or any other flexible material including, cloth, plastics, or metals.

Fluid entering the pump channel 308 from the input port (415 FIGS. 4A-B) is pushed to the output port of the channel (417 FIGS. 4A-B), leading to the output port 310, by movement of the roller components 312 as the rotatable portion is rotated.

The pump 300 can be formed from plastic out of a combination of components removably attached or fixed together, e.g., by sonic welding, laser welding, snap fit, friction fit, multi-shot molding, mechanical fasteners, etc. An o-ring or other seal or gasket can be positioned between the pump 300 and the fluid container to prevent liquid leaks. In some other implementations, the coupler 314 is configured to form a friction fit to the fluid container. The coupler 314 can further be sonic welded to the fluid container or sealed in another manner, e.g., using an adhesive.

Figure 4A:
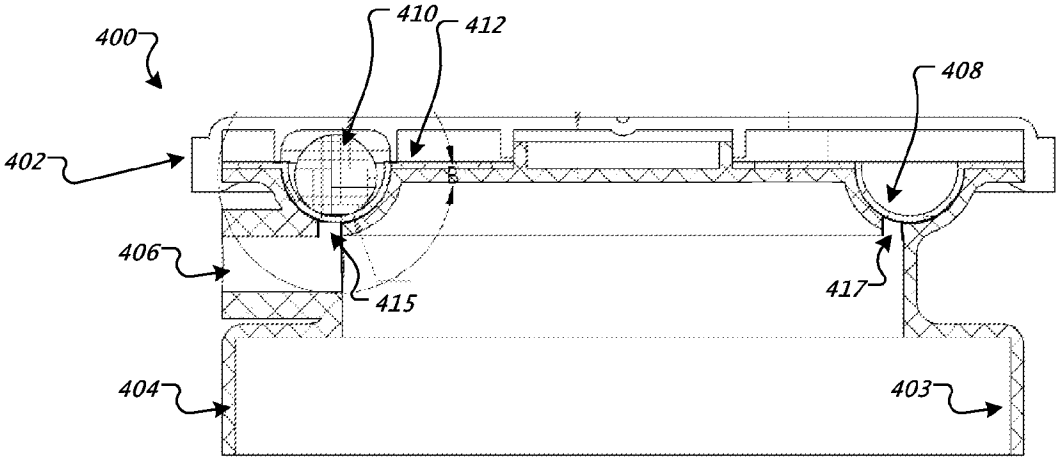
FIG. 4A-B show cutaway views of an example pump.
Figure 4B:
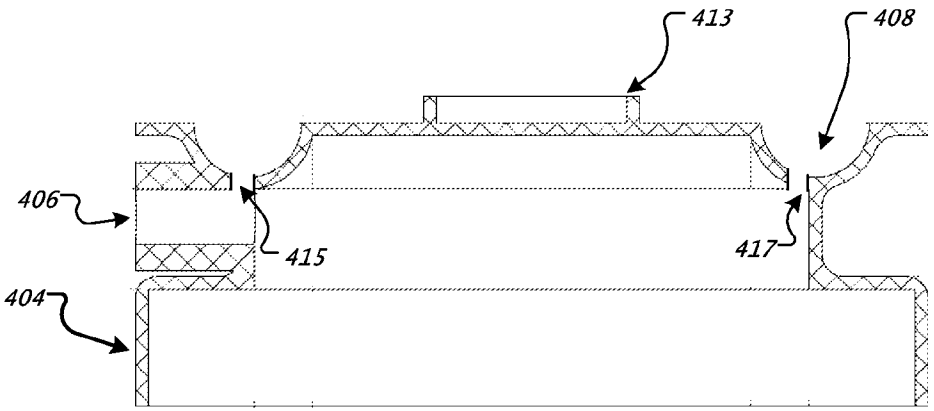

FIGS. 4A-B show cutaway views of an example pump 400. FIG. 4A shows a cutaway view of the pump 400 including a rotatable portion 402 and a base portion 404. FIG. 4B shows a cutaway view of just the base portion 404. The base portion 404 includes an output port 406 for dispensing fluids from the pump 400 and a coupler 403 for coupling the base portion to a container, e.g., a container with fluid to be dispensed. The base portion 404 can also include a raised portion 413 for coupling the base portion 404 to the rotatable portion 402. However, other structure for joining the base portion 404 and the rotatable portion 402 can be used.

The base portion 404 is shaped to form a channel 408. The channel 408 can be lined with a flexible membrane 412. In particular, as shown in FIG. 4A, the flexible membrane is distorted into the channel 408 by a roller component 410. Otherwise, e.g., in a relaxed state, the flexible membrane 412 is positioned above the surface of the channel 408 such that it can be compressed into the channel 408 to provide a seal during a pumping operation. Movement of the rotatable portion 402 causes the roller component 410 to traverse the channel 408 compressing the flexible membrane 412 as it travels. Fluid in space formed between walls of the channel and the rotatable portion 402 is pushed by the roller component 410 during rotation.

Figure 5:
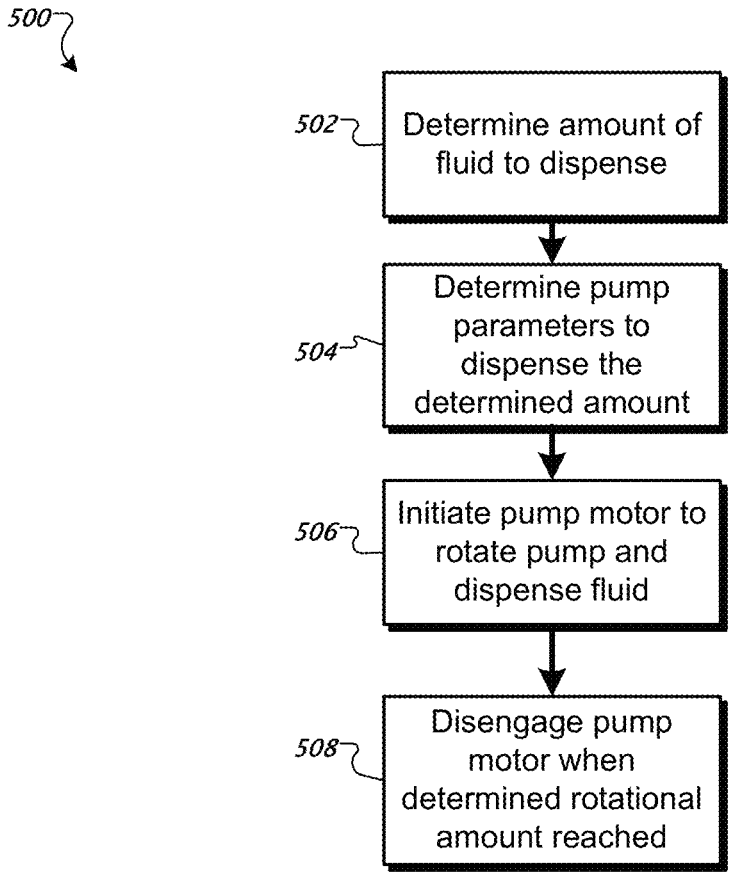
FIG. 5 shows a flow diagram of an example process for fluid pumping.

FIG. 5 shows a flow diagram of an example process 500 for pumping fluid. For convenience, the process 500 will be described with respect to a pumping system that performs the process 500.

The pumping system determines an amount of fluid to dispense 502. In some implementations, a specified volume about is input to the pumping system. For example, a user can input a specified volume, e.g., in ounces or milliliters, to a control of the pumping system. In some other implementations, a specified weight is input to the pumping system. The pumping system can include a scale that is coupled to a pump control such that the pump can be controlled in response to a measured weight.

In some other implementations, the amount of fluid to dispense is determined based on a specified operation. For example, particular operations can be associated with respective predefined fluid amounts corresponding to different operations. When a command is received to perform a specified operation, the system determines the amount of fluid to dispense for that operation.

The system determines one or more pumping parameters to dispense the determined amount 504. In some implementations, a pumping parameter is a specified amount of pumping time. The pumping time can be based on a known flow rate for a given fluid being dispensed. Different fluids can have different flow rates through the pump system as a function of time depending on the speed of the pump rotation. Therefore, in some implementations, the fluid is specified along with the amount to dispense so that the system can determine the pumping time given the amount of fluid and the flow rate for that fluid.

In some implementations, the pumping parameter is a specified rotational amount. The flow rate for a particular fluid can be specified in terms of amount per unit of rotation, e.g., amount per degree of rotation. Thus, for a given amount of a particular fluid, the system can determine the number of degrees of rotation to dispense the amount.

The system initiates a pump motor to rotate pump and dispense fluid (506). For example, a controller of the pump system can activate a pump motor which turns one or more gears coupled to a rotatable portion of the pump. As the pump rotates, as driven by the pump motor, fluid is pumped from a fluid container to an output. The motor rotates a drive shaft that causes a corresponding rotation of the pump (e.g., the rotatable portion of the pump) such that precise amounts of fluid are dispensed as a function of the motor speed, pump configuration, and the fluid being dispensed.

The system disengages the pump motor when determined amount of fluid is dispensed (508). Once the determined amount of fluid has been dispensed, the system can stop the pump motor there thereby stop the rotation of the pump. When the dispensed amount is determined based on a rotational amount or pumping time, the system can disengage the pump motor when the determined time or rotation has occurred. When the dispensed amount is determined based on a weight of dispensed fluid, the system can disengage the pump motor when the weight measured by the scale has been reached. Alternatively, the system can be calibrated to account for any residual fluid between the pump output and the destination (e.g., in a dispensing tube) that will be released so that substantially the exact amount of fluid is dispensed once the motor is deactivated. The motor can then be disengaged and the pump stopped prior to the determined weight being reached such that the residual fluid will bring the total weight to the determined amount.

The dispensed liquid can then be used for various applications. The fluid pump can be used to dispense fluids for use in a variety of processing including extrusion, blow molding, or film production. In particular, liquid colorants can be used to color various products (e.g., bottles). In some other implementations, the fluid pump can be used to dispense colorants for the coloring of waxes for candles and wine bottle seals, to dispense catalysts for thermoset plastics, and to dispense single and multiple component adhesives and sealants.

The operations described in this specification, in particular, processing commands for a motor to drive a pump to dispense a specified amount of fluid, e.g., by a controller, can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program can be deployed to be executed on one computer or on multiple computers that are located at one site or distributed across multiple sites and interconnected by a communication network.

Alternatively or in addition, the program instructions can be encoded on a computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A system comprising:

a fluid container; and a pump comprising:

a rotatable portion including one or more recesses configured to receive one or more corresponding roller components such that the positions of the roller components are maintained relative to the rotatable portion during rotation of the rotatable portion; and a base portion, wherein the base portion is shaped to include a channel formed within a surface of the base portion, the fluid channel having a circular path and a substantially semicircular cross section, the fluid channel further including an input aperture for providing fluid from the fluid container and an output aperture, the base portion further including a flexible membrane positioned above the fluid channel, the fluid channel being configured to receive the one or more roller components when the rotatable portion is coupled to the base portion such that each of the one or more roller components compresses the flexible membrane forming a seal in the fluid channel at the compression point, wherein the rotatable portion is rotatably coupled to the base portion such that rotation of the rotatable portion causes the one or more roller components to traverse the fluid channel causing the flexible membrane to be compressed against the fluid channel as each roller component moves pushing fluid trapped between the fluid channel and the membrane and between the one or more roller components in the direction of rotation along a path from the input aperture to the output aperture causing fluid to be pushed out the output aperture.

2. The system of claim 1, further comprising:

a coupler configured to couple the base portion to the fluid container such that fluid from the fluid container can enter the fluid channel through the input aperture.

3. The system of claim 1, wherein the rotatable portion further comprises:

a drive structure configured to cause the rotatable portion to rotate.

4. The system of claim 3, wherein the drive structure includes a plurality of gear teeth formed around an outer circumference of the rotatable portion.

5. The system of claim 3, further comprising:

a motor coupled to the pump using the drive structure.

6. The system of claim 3, wherein the drive structure includes a gear drive.

7. The system of claim 4, further comprising:

a controller configured to drive the motor to dispense a specified amount of fluid.

8. A method comprising:

receiving a command to dispense a specified amount of a fluid;

initiating a motor coupled to a fluid pump, the pump being coupled to a fluid container, wherein the motor causes a portion of the pump to rotate, and wherein rotation of the pump causes one or more roller components positioned within a fluid channel formed in a base portion of the fluid pump to traverse the fluid channel causing a flexible membrane positioned above the fluid channel to be compressed against the fluid channel as each roller component moves and wherein the traversal of the one or more roller components pushes fluid trapped between the fluid channel and the flexible membrane and between the one or more roller components in the direction of rotation along a path from an input aperture toward an output aperture causing fluid to be pushed out the output aperture; and stopping the motor when the specified amount of fluid has been pumped from the container.

9. A pump comprising:

a rotatable portion including one or more recesses configured to receive one or more corresponding roller components such that the positions of the roller components are maintained relative to the rotatable portion during rotation of the rotatable portion; and a base portion, wherein the base portion is shaped to include a channel formed within a surface of the base portion, the fluid channel having a circular path and a substantially semicircular cross section, the fluid channel further including an input aperture and an output aperture, the base portion further including a flexible membrane positioned above the fluid channel, the fluid channel being configured to receive the one or more roller components when the rotatable portion is coupled to the base portion such that each of the one or more roller components compresses the flexible membrane forming a seal in the fluid channel at the compression point, wherein the rotatable portion is rotatably coupled to the base portion such that rotation of the rotatable portion causes the one or more roller components to traverse the fluid channel causing the flexible membrane to be compressed against the fluid channel as each roller component moves pushing fluid trapped between the fluid channel and the membrane and between the one or more roller components in the direction of rotation along a path from the input aperture to the output aperture causing fluid to be pushed out the output aperture.

10. A system comprising:

a pump coupled to a motor and a fluid container, the pump comprising:

a rotatable portion including one or more recesses configured to receive one or more corresponding roller components such that the positions of the roller components are maintained relative to the rotatable portion during rotation of the rotatable portion, the rotatable portion configured to be driven by the motor; and a base portion, wherein the base portion is shaped to include a channel formed within a surface of the base portion, the fluid channel having a circular path and a substantially semicircular cross section, the fluid channel further including an input aperture for receiving fluid from the fluid container and an output aperture, the base portion further including a flexible membrane positioned above the fluid channel, the fluid channel being configured to receive the one or more roller components when the rotatable portion is coupled to the base portion such that each of the one or more roller components compresses the flexible membrane forming a seal in the fluid channel at the compression point, wherein the rotatable portion is rotatably coupled to the base portion such that rotation of the rotatable portion causes the one or more roller components to traverse the fluid channel causing the flexible membrane to be compressed against the fluid channel as each roller component moves pushing fluid trapped between the fluid channel and the membrane and between the one or more roller components in the direction of rotation along a path from the input aperture to the output aperture causing fluid to be pushed out the output aperture.

* * * * *